US009238947B2

(12) United States Patent
Kallal

(10) Patent No.: US 9,238,947 B2
(45) Date of Patent: Jan. 19, 2016

(54) WELLBORE TUBULAR HANDLING SYSTEM

(75) Inventor: Michael James Kallal, Calgary (CA)

(73) Assignee: DOWN FORCE TECHNOLOGY INC., Calgary (CA)

( * ) Notice: Subject to any disclaimer, the term of this patent is extended or adjusted under 35 U.S.C. 154(b) by 371 days.

(21) Appl. No.: 13/580,002

(22) PCT Filed: Feb. 28, 2011

(86) PCT No.: PCT/CA2011/000233

§ 371 (c)(1),
(2), (4) Date: Feb. 6, 2013

(87) PCT Pub. No.: WO2011/103674

PCT Pub. Date: Sep. 1, 2011

(65) Prior Publication Data

US 2013/0126186 A1 May 23, 2013

Related U.S. Application Data

(60) Provisional application No. 61/308,812, filed on Feb. 26, 2010.

(51) Int. Cl.

| | |
|---|---|
| ***E21B 19/16*** | (2006.01) |
| ***E21B 19/086*** | (2006.01) |
| ***E21B 15/00*** | (2006.01) |
| ***E21B 19/14*** | (2006.01) |

(52) U.S. Cl.

CPC ..... *E21B 19/086* (2013.01); *E21B 15/00* (2013.01); *E21B 19/14* (2013.01); *E21B 19/16* (2013.01)

(58) Field of Classification Search

CPC ..... E21B 19/02; E21B 19/08; E21B 19/084; E21B 19/16

See application file for complete search history.

(56) References Cited

U.S. PATENT DOCUMENTS

| | | | | |
|---|---|---|---|---|
| 3,280,520 | A * | 10/1966 | Woolslayer | 52/116 |
| 4,290,495 | A | 9/1981 | Elliston | |
| 4,336,840 | A | 6/1982 | Bailey | |
| 7,249,629 | B2 | 7/2007 | Cunningham et al. | |
| 2007/0193749 | A1 * | 8/2007 | Folk | 166/379 |
| 2009/0084558 | A1 * | 4/2009 | Bloom | 166/385 |

FOREIGN PATENT DOCUMENTS

| | | | |
|---|---|---|---|
| CA | 2485202 | | 2/2005 |
| CA | 2537511 | A1 | 8/2007 |
| CA | 2710944 | A1 | 1/2011 |
| WO | WO 03031243 | A2 | 4/2003 |

* cited by examiner

*Primary Examiner* — William P Neuder
(74) *Attorney, Agent, or Firm* — Bennett Jones LLP

(57) ABSTRACT

A wellbore tubular handling system and method for moving tubulars into a wellhead. The wellbore tubular handling system includes a service rig including a transport chassis, a mast pivotally connected to the transport chassis and moveable between a storage position and an erected position and a block supported on the mast; an upper snubbing unit pivotally connected to the mast, the upper snubbing unit including a first driving ram and a second driving ram, each including a mounted end and an outboard end, each of the first driving ram and the second driving ram being connected at the pivotal connection to the mast adjacent their mounted ends and a travelling snubbing slip assembly mounted to the outboard ends of the first driving ram and the second driving ram and being drivable toward and away from the mounted ends by the first driving ram and the second driving ram; and a stationary snubbing slip assembly configured for connection to the wellhead.

66 Claims, 11 Drawing Sheets

TOP BRACKET POSITIONS

BOTTOM BRACKET POSITIONS

WELLBORE TUBULAR HANDLING SYSTEM

The present invention relates to a wellbore tubular handling system and more specifically to a wellbore tubular handling system including the features of a snubbing unit and a service rig for performing completion services on an oil or gas well and a snubbing units and snubbing methods for forcing tubulars into and out of an oil or gas well.

BACKGROUND OF THE INVENTION

Snubbing is used in the oil and gas industry for performing well interventions/well completions on wells that are under pressure. A snubbing unit is used to force jointed tubing into and out of a well while maintaining the pressure in the well (i.e. not requiring the well to be killed). Unlike wireline or coiled tubing, which have an outer diameter that remains constant throughout its length, jointed tubing has a varying outer diameter (i.e. the collars where the sections of jointed tubing are connected tend to have a larger outer diameter) requiring the collars to be taken into account when the jointed tubing is forced into or out of a well.

A snubbing unit is typically a relatively tall structure. It must be tall enough to lift a section of jointed tubing above the well head to be connected to a section of jointed tubing extending out of the well head. It typically also has some hydraulically powered components. A stationary slip and a hydraulically powered traveling slip are also typically provided to force the jointed tubing in and out of the well. The traveling slips are used to grab the pipe section and drive the tubing section into or out of the well. The stationary slips are used to hold the tubing section in place in the well, while the stationary slips release the tubing section and are repositioned for the next stroke.

Snubbing units also typically require pressure control components to maintain the pressure in the well while the tubulars are being snubbed into or out of the well. These components provide sealing to the outside of the tubulars while the jointed tubing is being forcibly inserted into the well head and have to accommodate the increased outside diameters at the joints of the tubulars.

Typically, snubbing is often done with standalone structures. The standalone structure must be installed at the well head and the snubbing of the tubular string performed. Once the snubbing has been completed, the stand alone snubbing unit can be removed and a service rig brought in to perform completion services on a well. If for any reason more snubbing operations have to be performed before the completion services are finished, the service rig must be removed from the well head and the standalone structure put back in place around the well head to perform the additional snubbing operations.

SUMMARY OF THE INVENTION

In accordance with a broad aspect of the present invention, there is provided a wellbore tubular handling system for moving tubulars into a wellhead comprising: a service rig including a transport chassis, a mast pivotally connected to the transport chassis and moveable between a storage position and an erected position and a block supported on the mast; an upper snubbing unit pivotally connected to the mast, the upper snubbing unit including a first driving ram and a second driving ram, each including a mounted end and an outboard end, each of the first driving ram and the second driving ram being pivotally connected adjacent their mounted ends to the mast and a travelling snubbing slip assembly mounted to the outboard ends of the first driving ram and the second driving ram and being drivable by the first driving ram and the second driving ram toward and away from the mounted ends; and a stationary snubbing slip assembly configured for connection to the wellhead.

In accordance with another broad aspect of the present invention, there is provided a method for moving wellbore tubulars into a wellhead, the method comprising: setting up a service rig adjacent the wellhead, the service rig including a transport chassis, a mast pivotally connected to the transport chassis and moveable between a storage position and an erected position and a block supported on the mast; an upper snubbing unit connected by a pivotal connection to the mast, the upper snubbing unit including a first driving ram and a second driving ram, each including a mounted end and an outboard end, each of the first driving ram and the second driving ram being connected at the pivotal connection to the mast adjacent their mounted ends and a travelling snubbing slip assembly mounted between the outboard ends of the first driving ram and the second driving ram; positioning the mast in the erected position; connecting a stationary snubbing slip assembly to the well head; positioning the upper snubbing unit into a position for snubbing tubular into the wellhead; lifting a tubular into a position substantially aligned with a center well axis; gripping the tubular using the travelling snubbing slip assembly; driving the first driving ram and the second driving ram to drive the travelling snubbing slip assembly away from the mast and toward the stationary snubbing slip assembly to force the tubular through the stationary snubbing slip assembly and into the well head; and gripping the tubular using the stationary snubbing slip assembly.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
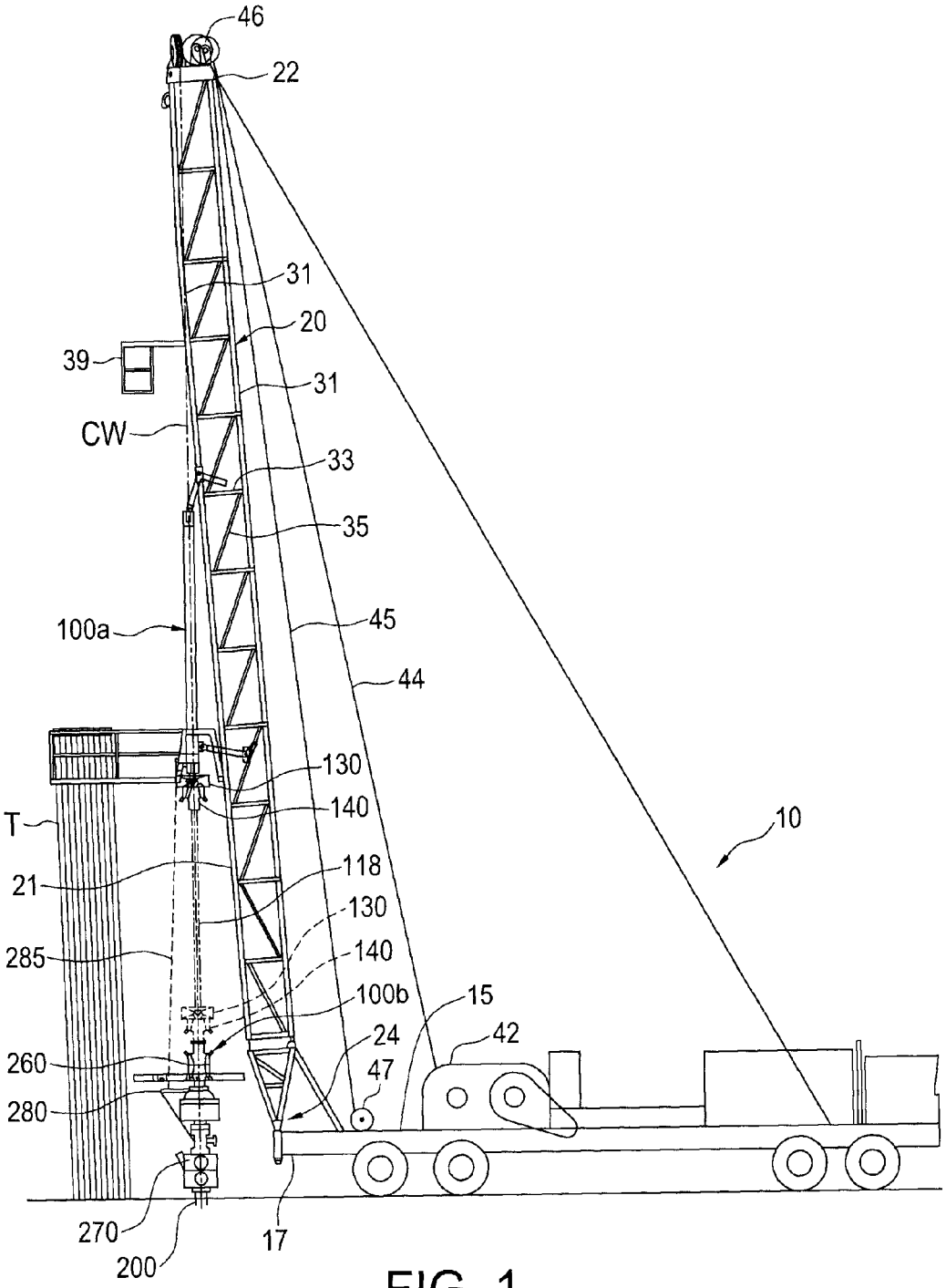
FIG. 1 is a side view of a service rig having a mast and a snubbing device, with the snubbing unit positioned to perform snubbing operations on a well.
Figure 2:
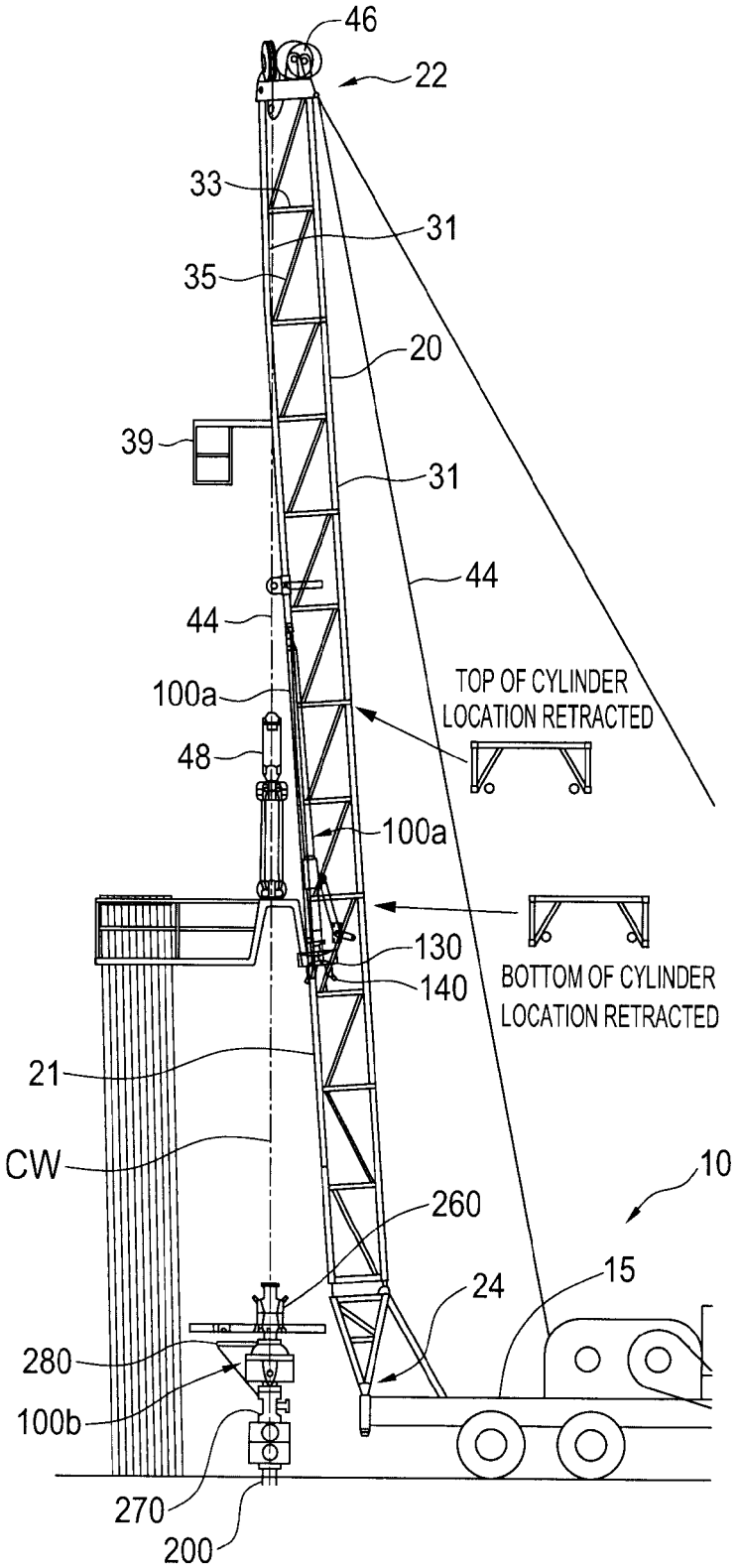
FIG. 2 is a side view of the service rig of FIG. 1 with the snubbing device in a retracted position.

FIGS. 1 and 2 illustrate a wellbore tubular handling system including a service rig 10 with a mast 20 and a snubbing apparatus 100*a*, 100*b* for snubbing jointed tubulars into and out of a well head 200 and a well accessed therethrough. While the term snubbing is used herein, it is to be understood that the apparatus could be used to pull pipe as well as injecting it. As such the apparatus 100*a*, 100*b* may be operated according to a more general pipe push/pull capability, as opposed to only for snubbing. The service rig 10 can be used for well completion work, such as logging, swabbing, perforating, etc. as well as snubbing tubular joints into the well through the well head 200. The service rig 10 can have an elongate derrick or mast 20 that can be erected over the well head 200 when the service rig 10 is positioned at the well site. The mast 20 has a top end 22 and a bottom end 24 with the bottom end 24 typically being pivotally mounted to a bed 15 of a transport chassis of the service rig 10. The bottom end 24 of the mast 20 can be pivotally connected to a rearmost end 17 of the bed 15 of the service rig 10. In this manner, the mast 20 can be placed in a transport position where it is pivoted substantially horizontally along the bed 15 of the service rig 10, allowing the service rig 10 to be transported to a well site. When the service rig 10 is positioned at a well site, the mast 20 can be placed in an erect position by pivoting it upwards away from the bed so that a top end 22 of the mast 20 is positioned substantially over the well head 200.

Typically, when the mast 20 is positioned in its erect position, the mast 20 is positioned in a slightly over-vertical position so that the top end 22 of the mast 20 can be positioned substantially over the well head 200, while the rear 17 of the bed 15 of the service rig 10 (where the bottom end 24 of the mast 20 is pivotally connected to the bed 15 of the service rig 10) can be positioned adjacent to the well head 200. In one aspect, the mast 20 can be positioned between 2°-10° from vertical (i.e. 90°). In this manner, a center line CW, running from the center of the well 200 to the top end 22 of the mast 20 can be provided with the front side 21 of the mast 20 clearing this center line CW. This allows a number of completion services to be performed on the well without the front side 21 of the mast 20 adversely affecting the performance of these services. For example, the mast is oriented to prevent the front side from blocking tools from operating along CW.

The service rig 10 can be provided with a basket 39 on the mast, a block including sheaves 46 provided on the top end 22 of the mast 20, one or more cables 44 roved through the sheaves, a traveling block 48 suspended in the mast on the cables and one or more drums 42 to drive the cables 44. In addition, a further one or more cables 45 are roved through the block and driven via winches 47 on the rig. These components allow the service rig 10 to provide a number of completion services including the handling of wellbore tubulars.

The mast 20 is typically formed from a number of elongate structural members 31 running along an axis defined by the length of the mast 20. A number of cross members 33 and cross braces 35 can be connected between the elongate structural members 31 to provide the elongate structural members 31 with structural rigidity.

The transport chassis of the service rig 10 can be skid, a trailer pulled behind a tow vehicle or a vehicle, such that the bed 15 may be carried on wheels, tracks, skid rails, etc.

A first portion of the snubbing apparatus, upper snubbing unit 100*a*, can be connected to the mast 20 so that it can be swung into an operative position, in place over top of a well head 200, substantially in line with the center line CW and used to perform snubbing operations on the well. The upper snubbing unit 100*a* can also be swung away, out of line with the center line CW of the well head 200 into a stored position when other well completion services are being performed on the well by the service rig 10.

The upper snubbing unit 100*a* can be connected to the mast 20 between the top end 22 of the mast 20 and the bottom end 24 of the mast 20.

Figure 3:
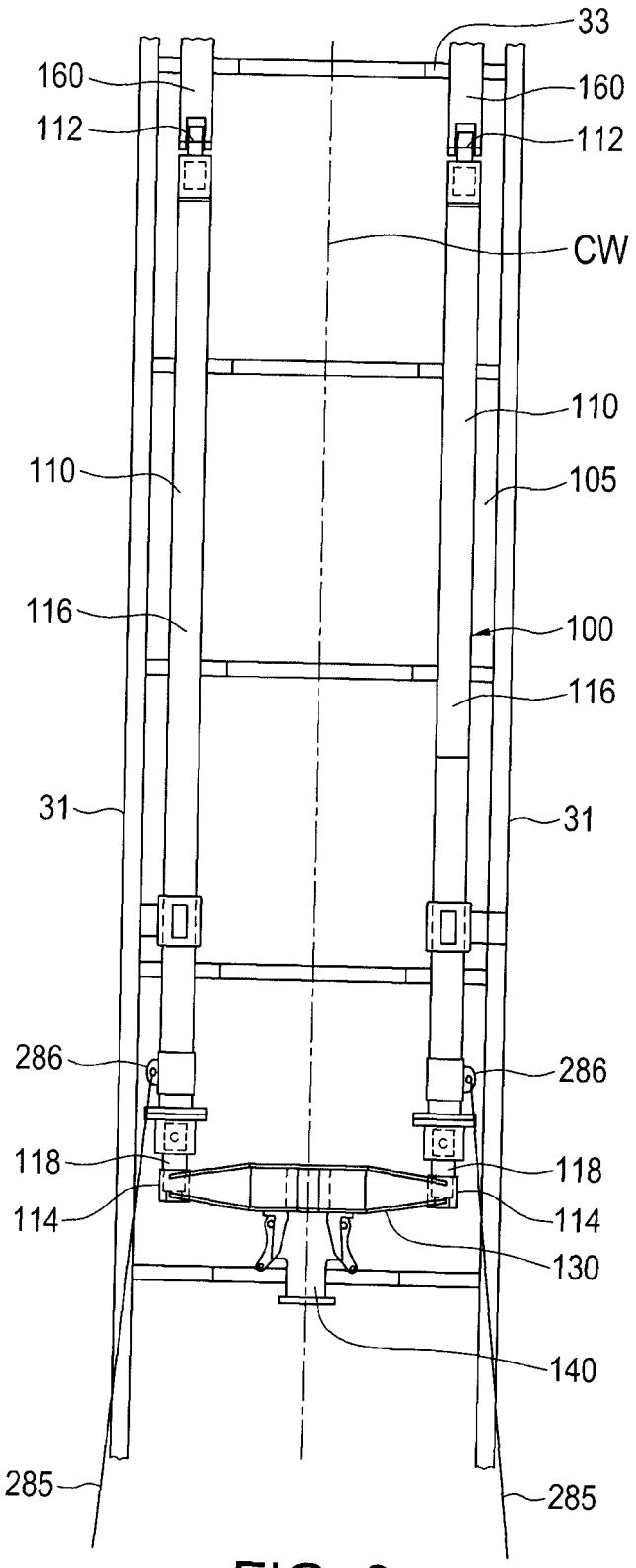
FIG. 3 is a front view of a snubbing unit.

FIG. 3 illustrates the snubbing unit 100*a* provided on the mast 20 and used for snubbing jointed tubulars into the well head 200 and therethrough into the well. In one aspect, the snubbing unit 100*a* can include a pair of hydraulic rams 110, each ram having a top end 112, a bottom end 114, a cylinder barrel 116 and a piston rod 118. As will be appreciated, the piston rod of a hydraulic ram has an end installed in the cylinder barrel and the piston rod drivable to extend and/or retract relative to the cylinder barrel by hydraulic pressure applied thereto. The hydraulic rams 110 can be 2-way (double acting) hydraulic rams such that they can be operated to both forcibly extend the piston rods 118 and forcibly retract the piston rods 118, relative to the barrels.

The hydraulic rams are connected adjacent their top ends 112 to the mast and the bottom ends extend outboard therefrom. The hydraulic rams are oriented such that the mounted, top ends 112 are above, with respect to gravity, the bottom, outboard ends 114 when the mast is in the erect position. As such, gravity may be of assistance to swing the hydraulic rams into the position over well center.

Figure 4A:
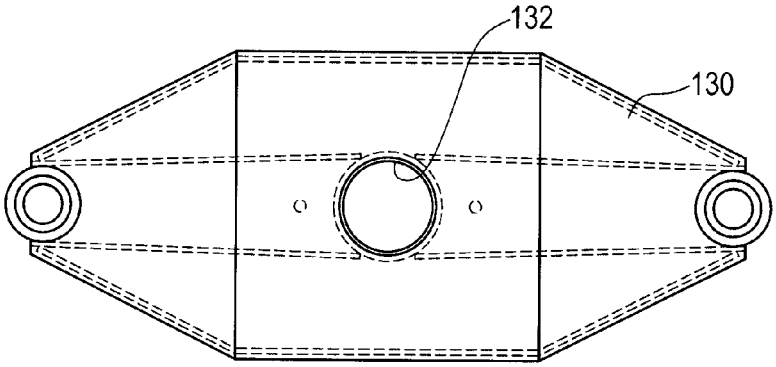
FIGS. 4A, 4B and 4C are views of a support plate attachable to the snubbing device of FIG. 3.
Figure 4B:
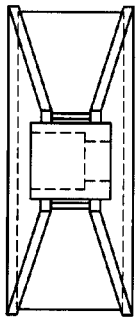
Figure 4C:
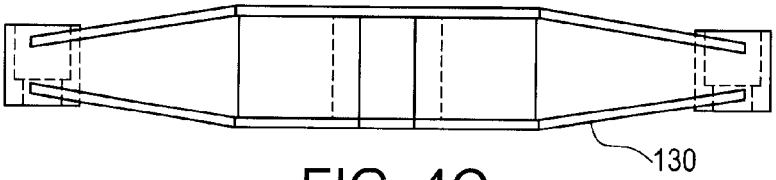

An upper slip assembly 140 can be carried on the outboard ends of the hydraulic rams. In particular, in one embodiment, the bottom ends 114 of the piston rods 118 can be connected to a support plate 130 having an aperture 132 shown in FIGS. 4A, 4B and 4C. The upper slip assembly 140 can be attached to the support plate 130. The upper slip assembly 140 includes an open bore with slips positioned circumferentially thereabout. When the upper slip assembly 140 is connected to the support plate 130, the open bore of the slip assembly is aligned with the aperture 132 of the support plate.

When the hydraulic rams 110 are extended, the bottom ends 114 of the piston rods 118 are extended away from the top ends 112 of the cylinder barrels 116, moving the support plate 130 and the slip assembly 140 down from the mast, away from the top ends 112 of the hydraulic rams 110. Likewise, when the hydraulic rams 110 are retracted to move the bottom ends 114 of the piston rods 118 back up toward the top ends 112 of the hydraulic rams 110, the support plate 130 and the slip assembly 140 move up toward the mast and the top ends 112. The hydraulic rams 110, therefore, drive the support plate 130 and upper slip assembly 140 to form the "traveling slips" portion of the snubbing assembly.

As noted above, the upper slip assembly has an open bore so that sections of tubulars can be inserted therein. The slips of the upper slip assembly 140 surround the open bore and can be actuated to radially advance and grip, or retract and release, any tubulars positioned therein. Hydraulics may be used to drive advancement and retraction of the slips. In combination, with the driving movement of hydraulic rams 110, a tubular can be gripped by the slips of upper slip assembly 140 and driven axially up or down by the force applied through the rams. With the upper snubbing unit 100*a* axially aligned above the wellhead, the upper snubbing unit 100*a*, by use of rams 110 and slip assembly 140 can control the movement of tubulars into the well. While the slips are gripping a tubular, rods 118 can be extended from the cylinder barrels 116 to drive a tubular into the wellhead, and thereby into the well, and the rods 118 can be retracted to lift a tubular out of the wellhead.

Figure 5:
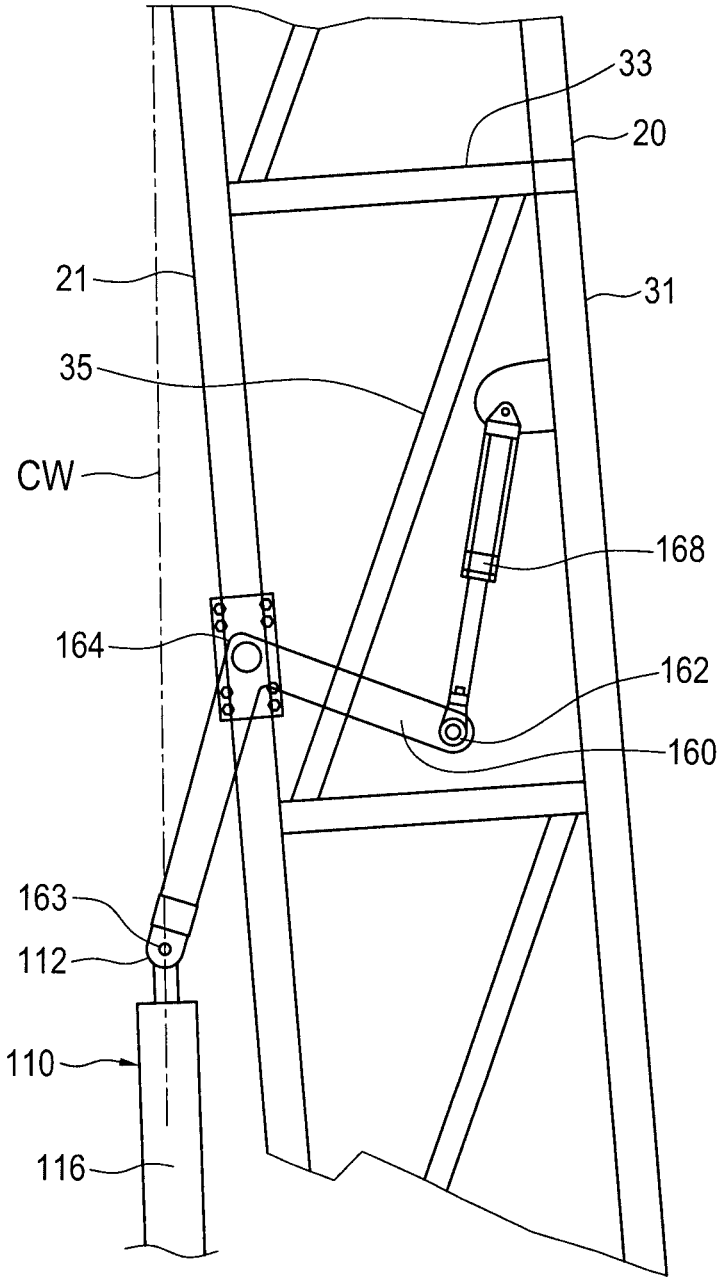
FIG. 5 is a fragmentary view of an upper connection arm for connecting the snubbing device to the mast.

FIG. 5 illustrates an embodiment of a connection between one of the hydraulic rams and the mast. In this illustrated embodiment, an upper connection arm 160 connects the top end 112 of one of the hydraulic rams 110 to the mast 20. The upper connection arm 160 can be attached to the mast 20 by a pivotal connection 164 and, in one aspect, can be an L-shaped bracket. An upper snubbing unit positioning apparatus can be provided for moving the upper snubbing unit about its pivotal connection between the stored position and the operative position. A hydraulic ram 168 can be mounted between the mast 20 and one end of the upper connection arm 160 so that the hydraulic ram 168 can be used to move the far end 162 of the upper connection arm 160 and thereby the top end 112 of the hydraulic cylinder 110 to which it is connected between a first position where the top end of the snubbing unit 100*a* is positioned substantially above a center of the well 200 along the center line CW (as shown in FIG. 1) and a second position wherein the top end of the snubbing unit 100*a* is positioned away from the center line CW, for example, offset from the center of the well and retracted inside the mast 20 (as shown in FIG. 2).

Figure 6:
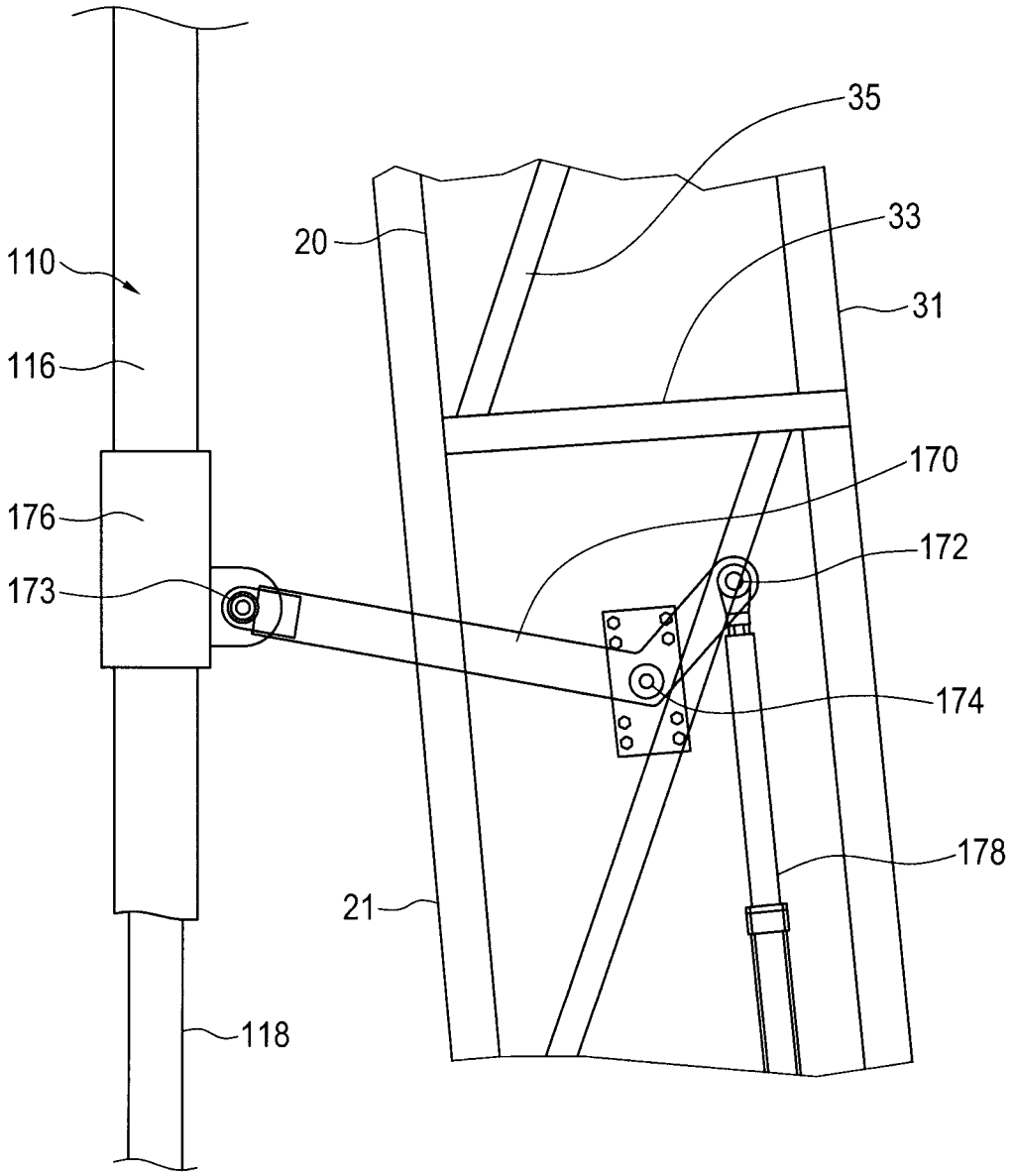
FIG. 6 is a fragmentary view of a lower connection arm for connecting the snubbing device to the mast.
Figure 7:
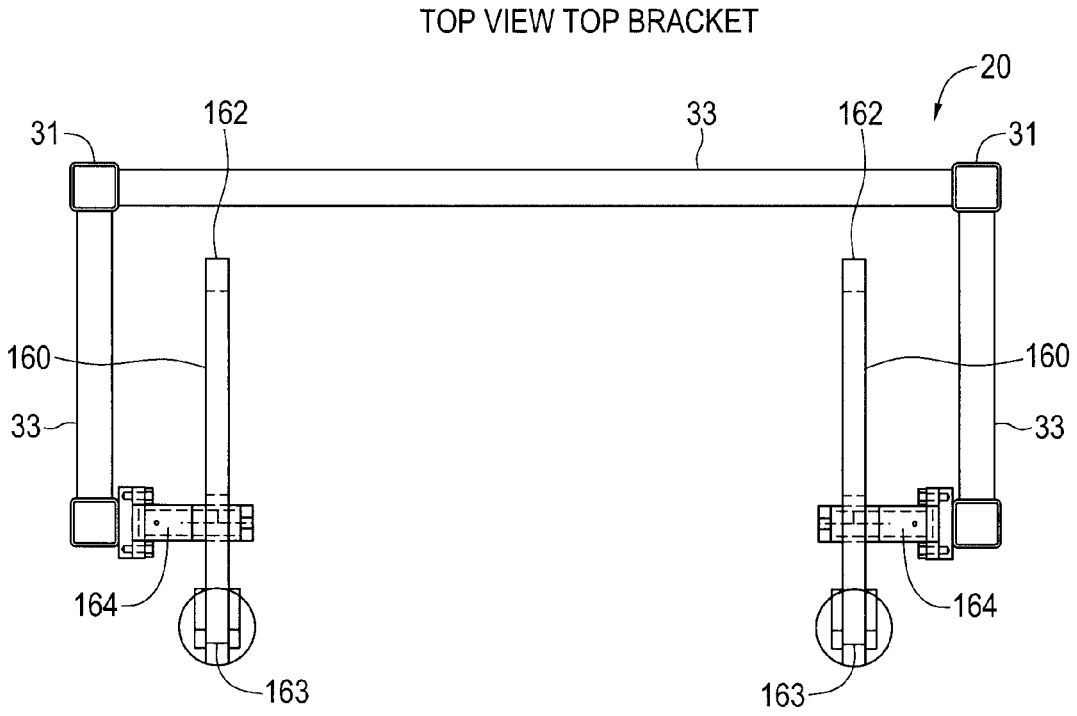
FIG. 7 is a top view of the upper connection arms.
Figure 8:
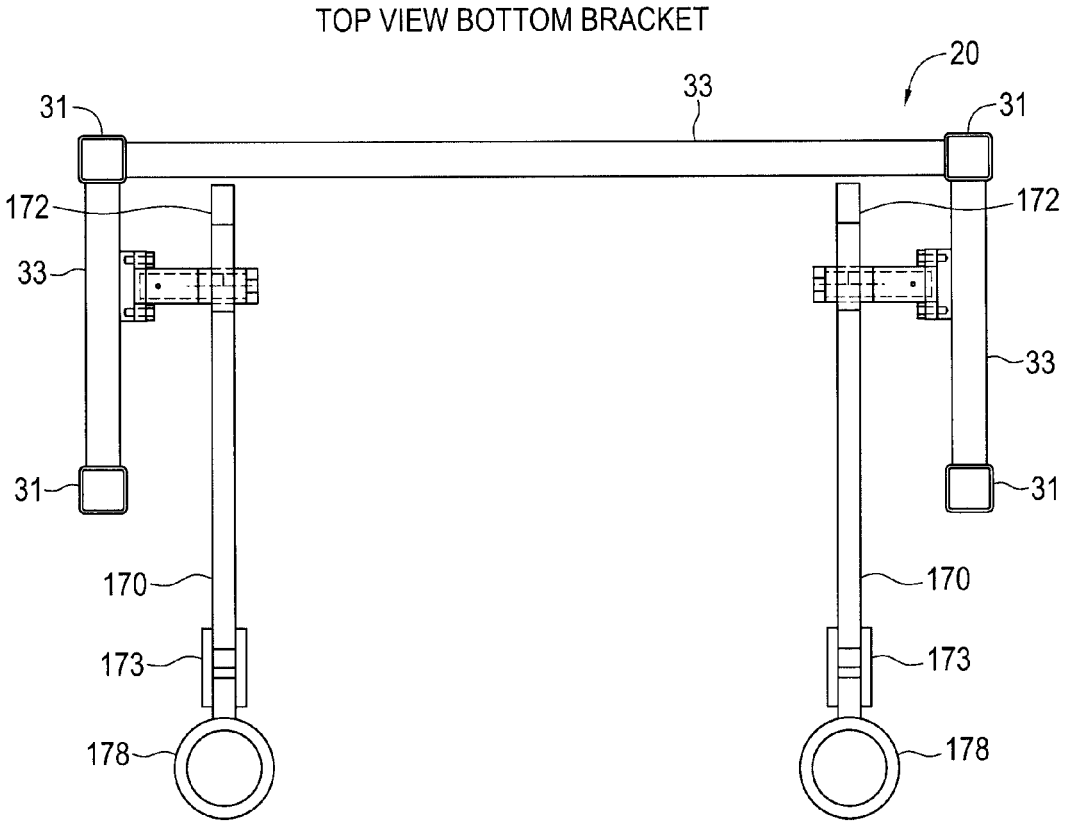
FIG. 8 is a top view of the lower connection arms.

In one embodiment, the hydraulic rams may be connected at further locations to the mast to permit further movement of the rams relative to the mast. For example, the rams may be pivotally connected at at least another position, along their length to the mast. FIG. 6, for example, illustrates a lower connection arm 170 connecting a lower, mid portion of the hydraulic ram to the mast 20. The lower connection arm 170 can be connected to the mast 20 by a pivotal connection 174 and in one aspect can be an L-shaped bracket. A hydraulic ram 178 can be mounted between one end 172 of the lower connection arm 170 and the mast 20 so that the hydraulic ram 110 can pivot the lower connection arm 170 around the pivotal connection 174. The second end 173 of the lower connection arm 170 can be pivotally attached to a bracket 176 that is slidably attachable to the cylinder barrels 116 of the hydraulic rams 110 used in the snubbing unit 100*a*. Bracket 176 can include a low friction inner facsing surface, for example of polymer or brass, such that the bracket can slide relatively freely along the outer surface of the barrel about which it is connected. As such, bracket 176 is moved by arm 170 and slides along barrel to drive movement of the lower end of the snubbing apparatus.

In effect, arms 160, 170 act as levers, each being driven about their fulcrum by cylinders to drive movement of snubbing unit 100*a* relative to mast 20.

Referring again to FIG. 3, a storage portion 105 of the mast 20 can be provided to allow the snubbing unit 100*a* to be retracted into the mast 20 when the snubbing unit 100*a* is not in use. The front side 21 of the mast 20 at the storage portion 105 forms a recess to accommodate the snubbing unit. For example, the mast can be U-shaped in cross section along at least a portion of its length, where the snubbing unit is connected, the opening between the arms of the U-shaped form providing the recess. In one embodiment, for example, the mast can be devoid of cross members 33 and cross braces 35 on at least a portion of its front side, this forming an opening through which the snubbing unit 100*a* can pass. In this manner, the snubbing unit 100*a* can be at least partially retracted inside the mast 20. The hydraulic rams 110 can be spaced apart at a distance that is less than the inside width of the mast 20 so that the snubbing unit 100*a* can be retracted inside the elongate members 31 surrounding the storage portion 105 of the mast 20. The pivotal connections 164, 174 can be provided on the inside of the elongate structures 31, the cross member 33 and/or the cross braces 35 on the sides of the mast 20.

When the snubbing unit 100*a* is not in use, such as when the service rig 10 is being used to perform completion services or when the mast 20 is pivoted adjacent to the bed 15 for transport, the upper connection arm 160 and the lower connection arm 170 can be placed in their second positions causing the snubbing unit 100*a* to be pivoted so that it is out of line with the center line CW of the well head 200 and, in one aspect, completely or partially retracted inside the mast 20, as shown in FIG. 2. When tubing is to be forced into or out of the well head 200 and the snubbing unit 100*a* is desired to be used, the hydraulic cylinders 168, 178 attached to the upper connection arms 160 and the lower connection arms 170, respectively, can be used to position the snubbing unit 100*a* in the first position, placing the snubbing unit 100*a* substantially in line with the center line CW of the well head 200, as shown in FIG. 1.

Figure 9:
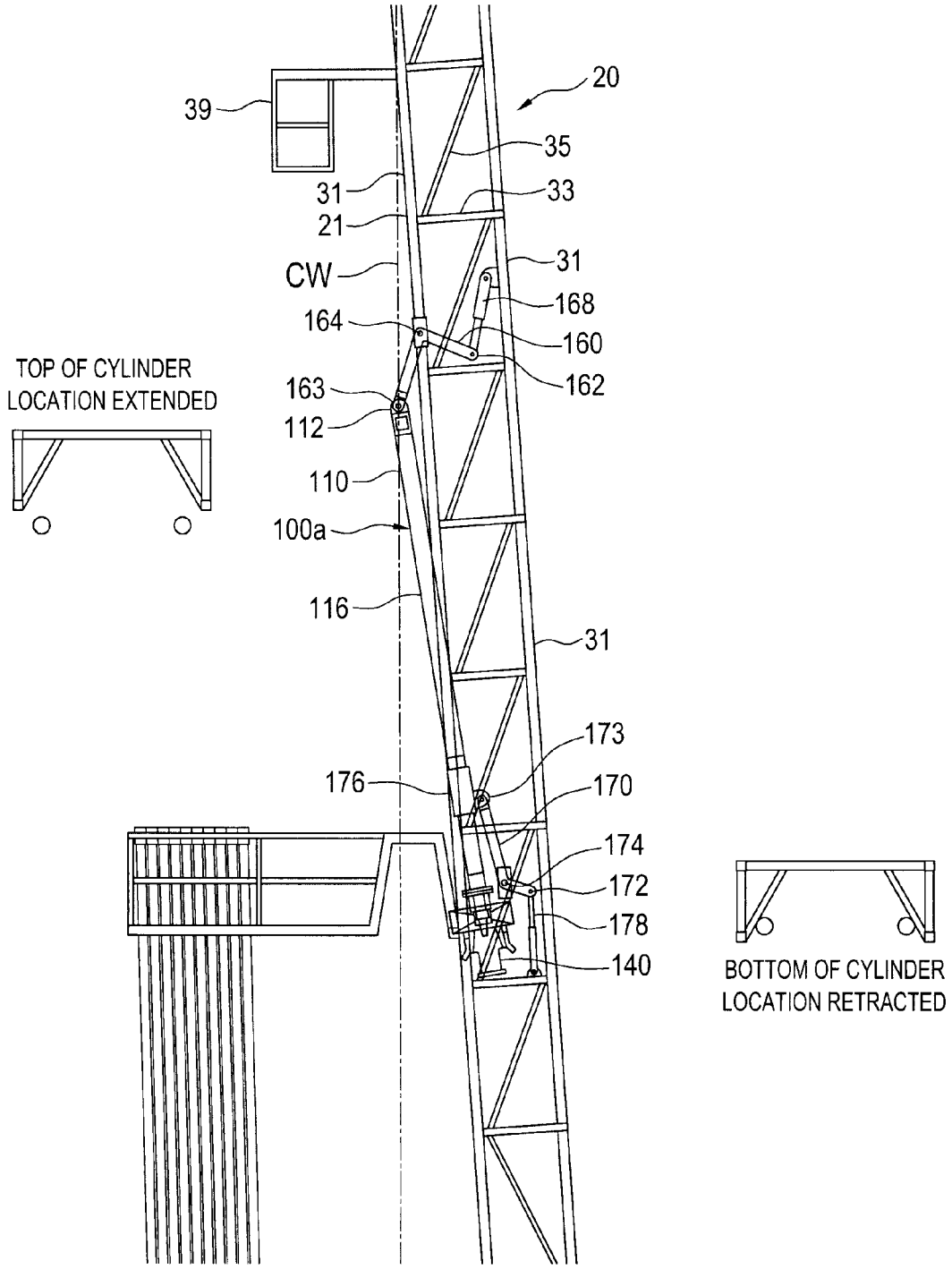
FIG. 9 is a fragmentary view of the snubbing device with lower connector arms positioning the bottom of the snubbing device in a retracted position.
Figure 10:
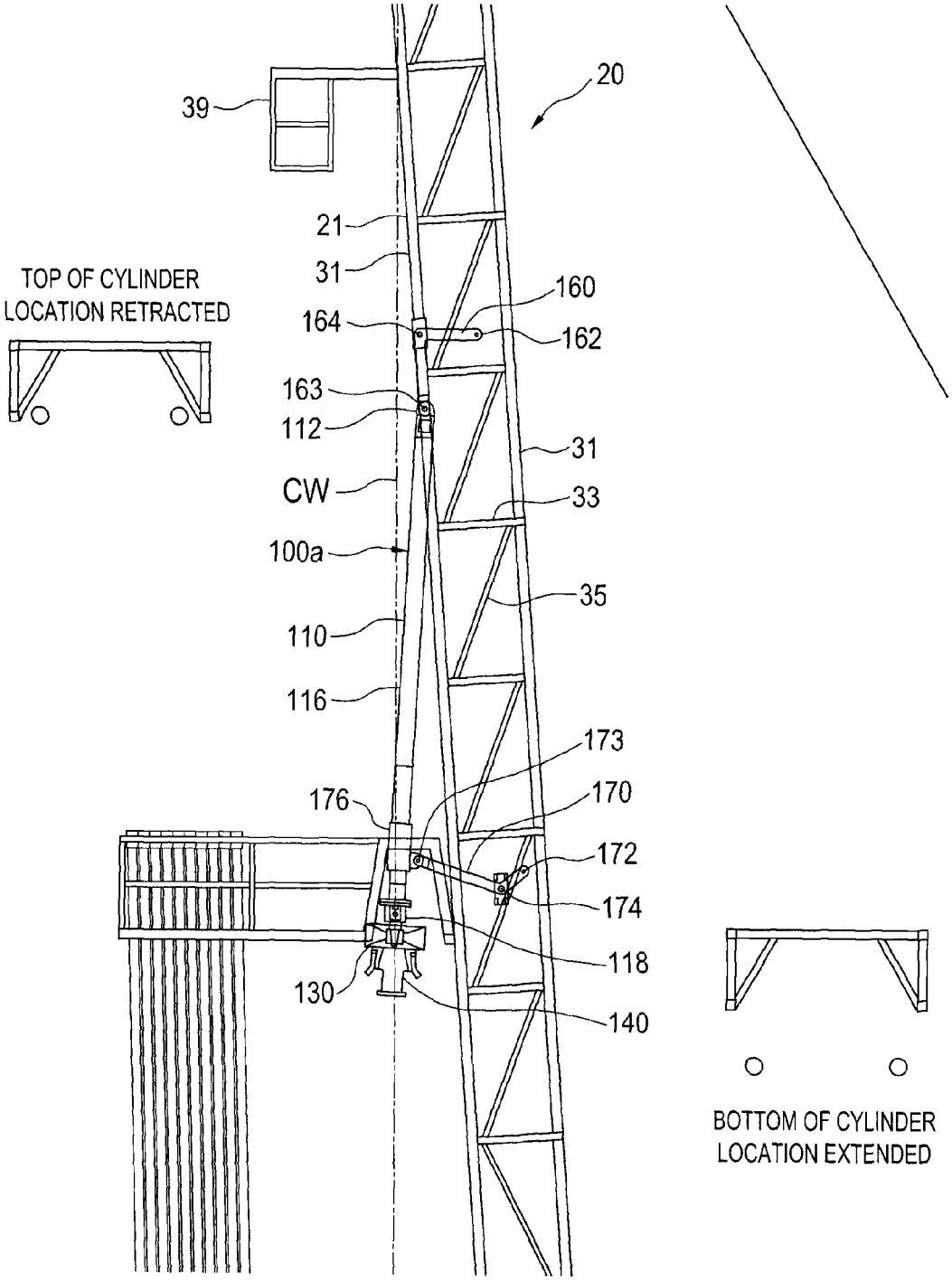
FIG. 10 is a fragmentary view of the snubbing device with the connector arms positioning the bottom of the snubbing device in an extended or operation position.
Figure 11:
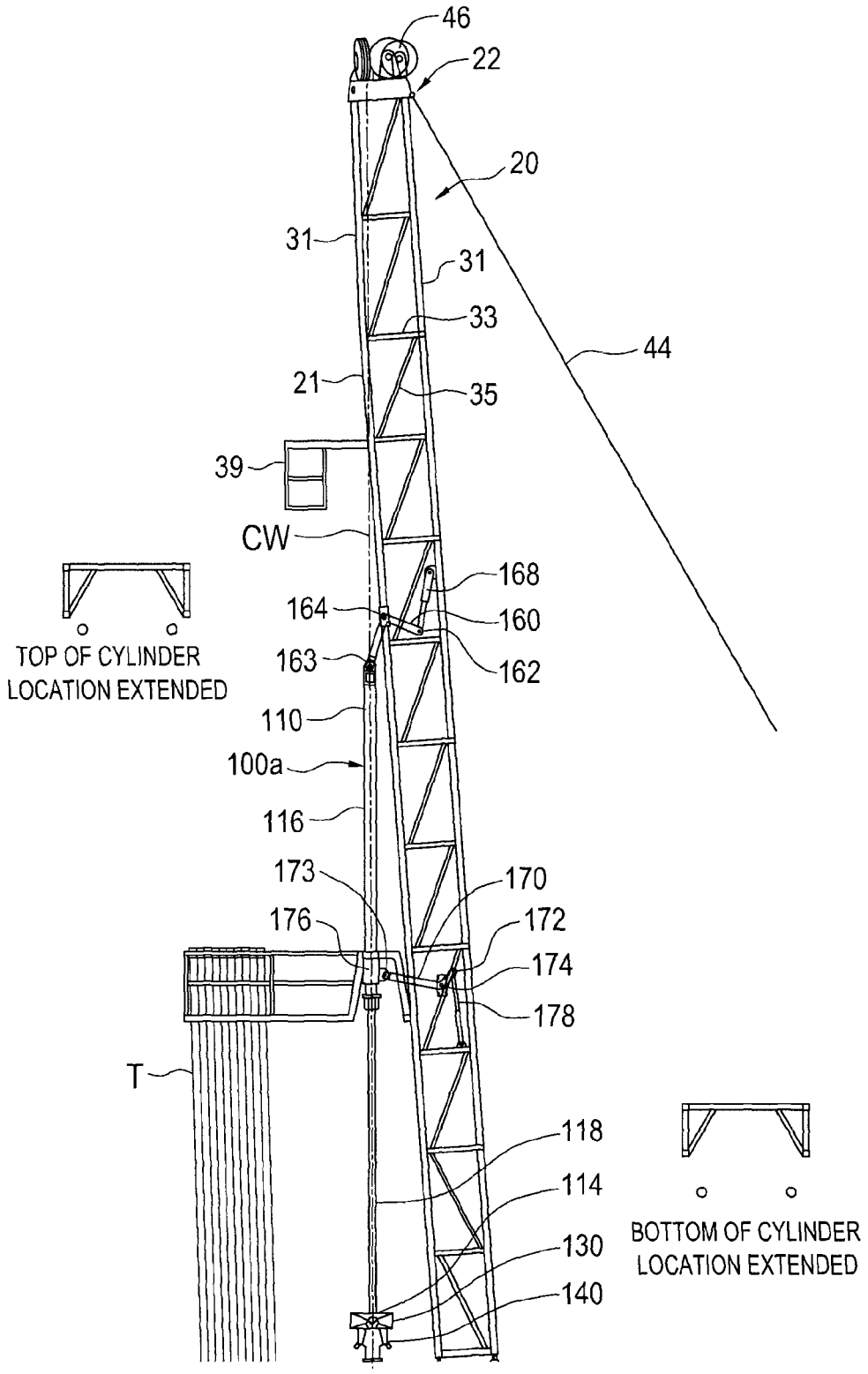
FIG. 11 is a fragmentary view of the snubbing device with the upper and lower connector arms positioning the snubbing unit along a center line substantially above a well head.

FIG. 9 illustrates the snubbing unit 100*a* with the top end 112 of the hydraulic rams 110 positioned in their first position along the center line CW while the lower portion of the hydraulic rams 110 remains retracted in its second position. FIG. 10 illustrates the snubbing unit 100*a* with the lower end of the hydraulic rams 110 moved inline with the center line CW while the top end 112 of the hydraulic rams 110 remain in their retracted second position. FIG. 11 illustrates the snubbing unit 100*a* with both the top end 112 of the hydraulic rams 110 and the lower portion of the hydraulic rams 110 extended to their first position, inline with the center line CW so that the snubbing unit 100*a* can be used to perform snubbing operations on the well head 200.

Referring again to FIGS. 1 and 2, the snubbing unit 100*a* provided on the mast 20 can be paired with a lower snubbing assembly 100*b* that is attached to the well head 200. The lower snubbing assembly 100*b* can be secured to the top of the well head 200. Typically, the well head 200 will have a standard flange connection and the lower snubbing assembly housing 100*b* can be secured to this flange. However, those skilled in the art will appreciate that various types of well head configurations and connections could be used. The lower snubbing assembly can include a lower slip assembly 260 that can act as the stationary slip for the snubbing process. The lower snubbing assembly has an open bore that is open to the well head 200 and therethrough to the well below so that sections of tubulars can be inserted through this open bore and into the well head 200 and the well below. The slips of the lower slip assembly 260 surround the open bore of the lower snubbing assembly and can be actuated to radially advance and grip or retract and release any tubulars passing therethrough, such that the slip assembly can control the movement of tubulars into the well. Hydraulics may be used to drive advancement and retraction of the slips.

The lower snubbing assembly 100*b* can also include sealing components 270 to seal the tubulars being introduced or removed from the well head 200 and maintain the pressure in the well. In one aspect, these sealing components 270 can include any or all of a stripping annular blow out preventer, spool, stripping rams, primary well control blow out preventer, etc., however, a person skilled in the art will appreciate that various different sealing components could be used depending on the specific configuration desired.

While there is no permanent connection between the upper snubbing unit 100*a* and the lower snubbing unit 100*b*/wellhead 200, when the units are in their operative positions at the wellsite, cables 285 can be attached between the wellhead 200 or lower snubbing unit 100*a* and the hydraulic rams 110 in the upper snubbing unit 100*a*. Cables 285 help to distribute the forces during the snubbing process and should be sized accordingly (such as 1⅛ inch flexible cable). For example, the cables can prevent lifting separation of the rams away from the wellhead during the driving of a tubular into the wellhead. Cables 285 also help position and maintain the snubbing unit 100*a* inline with the center line CW when the snubbing unit 100*a* is positioned over the well 200. Cables 285, however, should not interfere with the movement of the travelling slips and bottom plate. As such, cables 285, where they extend alongside the path of the travelling slips, should be spaced apart at least as wide as the width of rams 110.

A securement plate 280 can be provided for use with the lower snubbing assembly 100*b* to provide an anchor point for the cables 285. In one aspect, the securement plate 280 can be attached at any point in the wellhead stack, including at any flange connection therein. Securement plate 280 has a width approximately equal to or greater than the width of rams 110 and provides for anchoring of the cables at a spacing generally equal to or greater than the spacing between the cables at the rams. As such, the cables are out of the way of the travelling slips and stationary slips. In one embodiment, cables 285 are connected between the securement plate 280 and connection eyes 286 on the hydraulic rams 110. The eye on each hydraulic ram may, of course, be positioned on the cylinder barrel 116 or bracket 176, to accept connection of the cable and still be operable. In one aspect, two cables are attached between the wellhead and the upper snubbing unit 100*a*, one cable 285 being attached near the lower portion of the cylinder barrel 116 of each hydraulic ram 110 and being connected at the opposite end to the securement plate 280. A turnbuckle or other means may be employed to permit the cable to be tightened taut between the wellhead and the upper snubbing unit. The cable is disconnected between the upper snubbing unit and the wellhead when it is desired to move the upper snubbing unit into a stored position. The cable can be flexed to hang or lay down or may be removed altogether.

Referring to FIGS. 1-11, in operation, a tubular can be moved into and/or out of a well using the assembly. For example, a tubular can be injected into the well or pulled from the well using the snubbing apparatus. Alternately, the travelling block and associated cables and drums can be employed to apply a pulling force on the tubular or to run in tubulars when operating in a pipe heavy condition.

For example to drive a tubular into the well: first, the service rig 10 is set up adjacent the wellhead 200 with the mast in the erect position and the upper, travelling snubber slip assembly in the mast. The stationary snubbing slip assembly 100*b* is connected onto the wellhead 200. A tubular is then lifted into a position substantially aligned with the center well axis and the tubular is gripped using the travelling snubbing slip assembly. Thereafter, the hydraulic rams 110 are driven to drive the travelling snubbing slip assembly 140 away from the mast and toward the stationary snubbing slip assembly to force the tubular through the stationary snubbing slip assembly and into the well head. The tubular is then gripped using the stationary snubbing slip assembly. The travelling snubbing slip assembly can then release the tubular, ready to grip a next tubular.

In one embodiment for example with the service rig adjacent the wellhead, when it is desired to perform a snubbing operation on a well, rather than having to move the service rig 10 away from the site and erect a snubbing unit to perform the snubbing operations, the snubbing unit 100*a* can be moved from its retracted, second position out of line with the center line CW, as shown in FIG. 2 and into its extended first position inline with the center line CW and substantially centered over the well head 200, as shown in FIG. 1. If the lower snubbing unit 100*b* is not already installed on the wellhead, it can be brought in and connected to the wellhead 200. The lower snubbing unit being a separate component from the upper snubbing unit, it can be transported on the service rig, but handled separately and installed whenever it is appropriate to do so. For example, if the operator is moving between service and snubbing operations, the lower snubbing unit may be installed on the well but positioned with its slips retracted. In this position, service operations may be conducted through the lower snubbing unit, but it is in position to be readily actuated should the operator wish to commence snubbing operations.

After the upper snubbing unit and the lower snubbing unit are in place, the cables 285 can then be run from the lower snubbing unit, for example securement plate 280, to the hydraulic rams 110 in the upper snubbing unit 100*a*. The cables can then be tightened to help initiate and maintain positioning of the hydraulic rams 110 relative to the wellhead and to distribute and react forces during the snubbing process.

A string of tubulars can be snubbed (i.e. forcibly injected) into well 200 using the upper snubbing unit 100*a* and the lower snubbing unit 100*b*. Generally, a first tubular is held in the slips of the lower snubbing unit, an upper portion of which is exposed above the slips forming what may be termed a stump. The rams 110 may be driven extend the piston rods 118 to move the upper slip assembly 140 down close to and just above the upper end of the stump, which is the open end connection of the tubular held in the lower slip assembly. The piston rods and upper slip assembly are shown in phantom in this position in FIG. 1. In this position, the open bore of the upper slip assembly and the aperture 132 of the support plate are substantially aligned over well center CW. With the travelling block stored, a tubular T can be lifted using the mast 20, the winches 47 and cable 45 into place above the stump extending out of the well head 200. An operator can guide the section of tubular as it is being lowered towards the stump such that the tubular passes down through the aperture 132 in the support plate 130 and through the upper slip mechanism 140. The section of tubular can then be connected to the stump extending out of the well head 200. Once the section of tubular is attached to the stump, the rams 110 can be retracted to move the upper slip assembly 140 up along the outer surface of the tubular until it is positioned adjacent the upper end of the tubular and the slips of the upper slip assembly can be secured around the section of tubular. The lower slip assembly 260 may be loosened to allow the section of tubular to pass through the lower slip assembly 260. The hydraulic rams 110 of the snubbing unit 100*a* can then be driven to extend the piston rods 118, forcing the upper slip assembly 140 that grip the tubular towards the wellhead 200 and the lower slip assembly 260. This drives the tubular into the wellbore through the lower slip assembly and wellhead. Any force resisting the driving force may tend to push the upper slip assembly 140, rams 110 and thereby the mast 20 away from the wellhead. However, such force can be reacted back to the wellhead through the cables 285 to maintain stability of the system.

When the hydraulic rams 110 have reached the bottom of their stroke or the upper slip assembly 140 is close enough to the lower slip assembly 260, the lower slip assembly 260 can be tightened to grip the tubular while the upper slip assembly 140 on the upper snubbing unit 100*a* is loosened so it is not gripping the tubular. The hydraulic rams 110 of the snubbing unit 100*a* can then be retracted so that the support plate 140 and the upper slip assembly 150 are moved back up to a position ready to accept a next tubular. The next tubular can be connected to the stump formed by the previous section of tubular, now extending out of the well head 200 and the process is repeated to force the next section of tubular into the well head 200.

The snubbing unit 100*a* can be used while the joints of tubing in the well do not exceed the force exerted on the joints of tubing by the pressure in the well (pipe light conditions). Once the weight of the joints of tubulars overcome the force of the pressure in the well (pipe heavy conditions), the joints of tubing will fall freely and the drum 42 and traveling block 48 can be used to control the lowering of new sections of tubulars into the well head 200 because the weight of the tubing in the well will pull the joints of tubing into the well. For this process, the snubbing unit 100*a* can be moved back to its second position out of line with the center line CW to allow the travelling block to move along CW. To allow the upper snubbing unit to be stowed, cables 285 are removed such that there is no connection between the upper snubbing unit and the wellhead.

Whenever the service rig is needed to conduct non snubbing operations, the snubbing unit 100*a* can be moved back to its second position out of line with the center line CW.

In another aspect, the snubbing unit 100*a* may be used when the well is horizontal or contains horizontal sections and the friction in the well on the tubulars in the horizontal sections no longer allows the tubulars to fall freely into the well. In this situation, the snubbing unit 100*a* can be used to overcome the forces of friction and drive the tubulars into the well.

The snubbing unit 100*a* can also be used to remove a string of tubulars from the well by using the upper snubbing unit 100*a* and the lower snubbing assembly 100*b* to pull tubular sections out of the well head 200 using the hydraulic rams 110.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

I claim:

1. A wellbore tubular handling system for moving tubulars into a wellhead comprising: a service rig, a mast pivotally connected to the service rig and moveable between a storage position and an erected position, and a block supported on the mast, a cable rove through the block, a travelling block carried on the cable and hung in the mast and a drum for moving the cable through the block; an upper snubbing unit pivotally connected to the mast, the upper snubbing unit including a first driving ram and a second driving ram, each including a mounted end and an outboard end, each of the first driving ram and the second driving ram being connected at the pivotal connection to the mast adjacent their mounted ends and a travelling snubbing slip assembly mounted to the outboard ends of the first driving ram and the second driving ram and being drivable toward and away from the mounted ends by the first driving ram and the second driving ram; and a stationary snubbing slip assembly configured for connection to the wellhead.

2. The wellbore tubular handling system of claim 1 further comprising an upper snubbing unit positioning apparatus for moving the upper snubbing unit about its pivotal connection between a stored position and an operative position.

3. The wellbore tubular handling system of claim 2 wherein the upper snubbing unit positioning apparatus includes a hydraulic cylinder for driving the upper snubbing unit about its pivotal connection.

4. The wellbore tubular handling system of claim 3 further comprising a second hydraulic cylinder for driving the upper snubbing unit about a second pivotal connection to the mast.

5. The wellbore tubular handling system of claim 2 wherein the mast includes a recess into which the upper snubbing unit is drawn when in the stored position.

6. The wellbore tubular handling system of claim 1 further comprising a tensioned cable connected between the upper snubbing unit and the wellhead to distribute forces of a snubbing operation from the upper snubbing unit to the wellhead.

7. The wellbore tubular handling system of claim 1 wherein the upper snubbing unit is devoid of any permanent connections to the stationary snubbing slip assembly.

8. The wellbore tubular handling system of claim 1 wherein the travelling slip assembly is driven away from the mounted ends by extending piston rods of the first driving ram and the second driving ram.

9. A method for moving wellbore tubulars into a wellhead, the method comprising: setting up a service rig adjacent the wellhead, the service rig, a mast pivotally connected to the service rig and moveable between a storage position and an erected position and a block supported on the mast; an upper snubbing unit connected by a pivotal connection to the mast, the upper snubbing unit including a first driving ram and a second driving ram, each including a mounted end and an outboard end, each of the first driving ram and the second driving ram being connected at the pivotal connection to the mast adjacent their mounted ends and a travelling snubbing slip assembly mounted between the outboard ends of the first driving ram and the second driving ram; positioning the mast in the erected position; connecting a stationary snubbing slip assembly to the well head; positioning the upper snubbing unit into a position for snubbing tubular into the wellhead; lifting a tubular into a position substantially aligned with a center well axis, including connecting a cable to the tubular and operating a winch to move the cable through the block; gripping the tubular using the travelling snubbing slip assembly; driving the first driving ram and the second driving ram to drive the travelling snubbing slip assembly away from the mast and toward the stationary snubbing slip assembly to force the tubular through the stationary snubbing slip assembly and into the well head; and gripping the tubular using the stationary snubbing slip assembly.

10. The method of claim 9 wherein driving the first driving ram and the second driving ram includes extending piston rods to push against the mast.

11. The method of claim 9 further comprising connecting a tensioned cable between the wellhead and the upper snubbing unit to distribute forces generated during driving from the upper snubbing unit to the wellhead.

12. The method of claim 9 wherein after gripping the tubular using the stationary snubbing slip assembly, the method further comprises moving the upper snubbing unit into a stored position and conducting well service operations including operating a travelling block using the service rig to conduct well service operations.

13. The method of claim 12 wherein during moving the upper snubbing unit, the stationary snubbing slip assembly remains connected to the wellhead.

14. The method of claim 12 wherein after conducting well service operations, the method further comprises moving the upper snubbing unit into a position with its axis installed over well center to operate the travelling snubbing slip assembly to drive another tubular relative to the well.

15. The method of claim 9 wherein after gripping the tubular using the stationary snubbing slip assembly, the method further comprises moving the upper snubbing unit into a stored position and lowering the mast into the storage position.

16. A wellbore tubular handling system for moving tubulars into a wellhead, the system being mountable to a slightly over-vertical mast at or near the wellhead, the system comprising:

a block supportable on the mast, a cable rove through the block, a travelling block carried on the cable and hangable in the mast and a drum for moving the cable through the block;

an upper snubbing unit pivotally connectable to the mast at a first pivotal connection, the upper snubbing unit including a first driving ram and a second driving ram, each including a mounted end and an outboard end, each of the first driving ram and the second driving ram being pivotally connectable to the mast adjacent their mounted ends;

a travelling snubbing slip assembly mounted to the outboard ends of the first driving ram and the second driving ram and being drivable toward and away from the mounted ends by the first driving ram and the second driving ram; and a stationary snubbing slip assembly configured for connection to the wellhead.

17. The wellbore tubular handling system of claim 16 further comprising an upper snubbing unit positioning apparatus for moving the upper snubbing unit about the first pivotal connection between a stored position and an operative position.

18. The wellbore tubular handling system of claim 17 wherein the upper snubbing unit positioning apparatus includes a hydraulic cylinder for driving the upper snubbing unit about the first pivotal connection.

19. The wellbore tubular handling system of claim 18 wherein the upper snubbing unit is further pivotally connectable to the mast at a second pivotal connection, and the system further comprising a second hydraulic cylinder for driving the upper snubbing unit about the second pivotal connection.

20. The wellbore tubular handling system of claim 17 wherein, when connected to the mast and in the stored position, the upper snubbing unit is recessed on to the mast.

21. The wellbore tubular handling system of claim 16 further comprising a tensioned cable connected between the upper snubbing unit and the wellhead to distribute forces of a snubbing operation from the upper snubbing unit to the wellhead.

22. The wellbore tubular handling system of claim 16 wherein the upper snubbing unit is devoid of any permanent connections to the stationary snubbing slip assembly.

23. The wellbore tubular handling system of claim 16 wherein the first and second driving rams each comprises a piston rod and wherein the travelling slip assembly is driven away from the mounted ends by extending piston rods of the first and second driving rams.

24. A method for moving wellbore tubulars into a wellhead, the method comprising:

supporting a block on a mast at or near the wellhead, the mast being in a slightly over-vertical position;

connecting an upper snubbing unit by a pivotal connection to the mast, the upper snubbing unit including a first driving ram and a second driving ram, each including a mounted end and an outboard end;

connecting each of the first driving ram and the second driving ram at the pivotal connection adjacent their mounted ends, the outboard ends having a travelling snubbing slip assembly mounted therebetween;

connecting a stationary snubbing slip assembly to the wellhead;

positioning the upper snubbing unit into a position for snubbing tubular into the wellhead;

lifting a tubular into a position substantially aligned with a center well axis, including connecting a cable to the tubular and operating a winch to move the cable through the block;

gripping the tubular using the travelling snubbing slip assembly;

driving the first driving ram and the second driving ram to drive the travelling snubbing slip assembly away from the mast and toward the stationary snubbing slip assembly to force the tubular through the stationary snubbing slip assembly and into the wellhead; and gripping the tubular using the stationary snubbing slip assembly.

25. The method of claim 24 wherein the first driving ram and the second driving ram each comprise a piston rod and wherein driving the first driving ram and the second driving ram includes extending the piston rods to push against the mast.

26. The method of claim 24 further comprising connecting a tensioned cable between the wellhead and the upper snubbing unit to distribute forces generated during driving from the upper snubbing unit to the wellhead.

27. The method of claim 24 wherein after gripping the tubular using the stationary snubbing slip assembly, the method further comprises moving the upper snubbing unit into a stored position and conducting well service operations including operating a travelling block using a service rig to conduct well service operations.

28. The method of claim 27 wherein during moving the upper snubbing unit, the stationary snubbing slip assembly remains connected to the wellhead.

29. The method of claim 27 wherein after conducting well service operations, the method further comprises moving the upper snubbing unit into a position with its axis installed over well center to operate the travelling snubbing slip assembly to drive another tubular relative to the wellhead.

30. The method of claim 24 wherein after gripping the tubular using the stationary snubbing slip assembly, the method further comprises moving the upper snubbing unit into a stored position and lowering the mast into a storage position.

31. A wellbore tubular handling system for moving tubulars into a wellhead comprising: a service rig, a mast pivotally connected to the service rig and moveable between a storage position and an erected position, and a block supported on the mast; an upper snubbing unit pivotally connected to the mast, the upper snubbing unit including a first driving ram and a second driving ram, each including a mounted end and an outboard end, each of the first driving ram and the second driving ram being connected at the pivotal connection to the mast adjacent their mounted ends and a travelling snubbing slip assembly mounted to the outboard ends of the first driving ram and the second driving ram and being drivable toward and away from the mounted ends by the first driving ram and the second driving ram; a stationary snubbing slip assembly configured for connection to the wellhead; and an upper snubbing unit positioning apparatus for moving the upper snubbing unit about its pivotal connection between a stored position and an operative position, wherein the upper snubbing unit positioning apparatus includes a hydraulic cylinder for driving the upper snubbing unit about its pivotal connection.

32. The wellbore tubular handling system of claim 31 further comprising a cable rove through the block, a travelling block carried on the cable and hung in the mast and a drum for moving the cable through the block.

33. The wellbore tubular handling system of claim 32 further comprising a second hydraulic cylinder for driving the upper snubbing unit about a second pivotal connection to the mast.

34. The wellbore tubular handling system of claim 31 wherein the mast includes a recess into which the upper snubbing unit is drawn when in the stored position.

35. The wellbore tubular handling system of claim 31 further comprising a tensioned cable connected between the upper snubbing unit and the wellhead to distribute forces of a snubbing operation from the upper snubbing unit to the wellhead.

36. The wellbore tubular handling system of claim 31 wherein the upper snubbing unit is devoid of any permanent connections to the stationary snubbing slip assembly.

37. The wellbore tubular handling system of claim 31 wherein the travelling slip assembly is driven away from the mounted ends by extending piston rods of the first driving ram and the second driving ram.

38. A wellbore tubular handling system for moving tubulars into a wellhead comprising: a service rig, a mast pivotally connected to the service rig and moveable between a storage position and an erected position, and a block supported on the mast; an upper snubbing unit pivotally connected to the mast, the upper snubbing unit including a first driving ram and a second driving ram, each including a mounted end and an outboard end, each of the first driving ram and the second driving ram being connected at the pivotal connection to the mast adjacent their mounted ends and a travelling snubbing slip assembly mounted to the outboard ends of the first driving ram and the second driving ram and being drivable toward and away from the mounted ends by the first driving ram and the second driving ram; a stationary snubbing slip assembly configured for connection to the wellhead; and an upper snubbing unit positioning apparatus for moving the upper snubbing unit about its pivotal connection between a stored position and an operative position, wherein the mast includes a recess into which the upper snubbing unit is drawn when in the stored position.

39. The wellbore tubular handling system of claim 38 further comprising a tensioned cable connected between the upper snubbing unit and the wellhead to distribute forces of a snubbing operation from the upper snubbing unit to the wellhead.

40. The wellbore tubular handling system of claim 38 wherein the upper snubbing unit is devoid of any permanent connections to the stationary snubbing slip assembly.

41. The wellbore tubular handling system of claim 38 wherein the travelling slip assembly is driven away from the mounted ends by extending piston rods of the first driving ram and the second driving ram.

42. A wellbore tubular handling system for moving tubulars into a wellhead comprising: a service rig, a mast pivotally connected to the service rig and moveable between a storage position and an erected position, and a block supported on the mast; an upper snubbing unit pivotally connected to the mast, the upper snubbing unit including a first driving ram and a second driving ram, each including a mounted end and an outboard end, each of the first driving ram and the second driving ram being connected at the pivotal connection to the mast adjacent their mounted ends and a travelling snubbing slip assembly mounted to the outboard ends of the first driving ram and the second driving ram and being drivable toward and away from the mounted ends by the first driving ram and the second driving ram; a stationary snubbing slip assembly configured for connection to the wellhead; and a tensioned cable connected between the upper snubbing unit and the wellhead to distribute forces of a snubbing operation from the upper snubbing unit to the wellhead.

43. The wellbore tubular handling system of claim 42 further comprising an upper snubbing unit positioning apparatus for moving the upper snubbing unit about its pivotal connection between a stored position and an operative position.

44. The wellbore tubular handling system of claim 42 wherein the upper snubbing unit is devoid of any permanent connections to the stationary snubbing slip assembly.

45. The wellbore tubular handling system of claim 42 wherein the travelling slip assembly is driven away from the mounted ends by extending piston rods of the first driving ram and the second driving ram.

46. A method for moving wellbore tubulars into a wellhead, the method comprising: setting up a service rig adjacent the wellhead, the service rig, a mast pivotally connected to the service rig and moveable between a storage position and an erected position and a block supported on the mast; an upper snubbing unit connected by a pivotal connection to the mast, the upper snubbing unit including a first driving ram and a second driving ram, each including a mounted end and an outboard end, each of the first driving ram and the second driving ram being connected at the pivotal connection to the mast adjacent their mounted ends and a travelling snubbing slip assembly mounted between the outboard ends of the first driving ram and the second driving ram; positioning the mast in the erected position; connecting a stationary snubbing slip assembly to the well head; positioning the upper snubbing unit into a position for snubbing tubular into the wellhead; lifting a tubular into a position substantially aligned with a center well axis; gripping the tubular using the travelling snubbing slip assembly; driving the first driving ram and the second driving ram to drive the travelling snubbing slip assembly away from the mast and toward the stationary snubbing slip assembly to force the tubular through the stationary snubbing slip assembly and into the well head; gripping the tubular using the stationary snubbing slip assembly; and connecting a tensioned cable between the wellhead and the upper snubbing unit to distribute forces generated during driving from the upper snubbing unit to the wellhead.

47. The method of claim 46 wherein driving the first driving ram and the second driving ram includes extending piston rods to push against the mast.

48. The method of claim 46 wherein after gripping the tubular using the stationary snubbing slip assembly, the method further comprises moving the upper snubbing unit into a stored position and conducting well service operations including operating a travelling block using the service rig to conduct well service operations and during moving the upper snubbing unit, the stationary snubbing slip assembly remains connected to the wellhead.

49. The method of claim 46 wherein after gripping the tubular using the stationary snubbing slip assembly, the method further comprises moving the upper snubbing unit into a stored position and conducting well service operations including operating a travelling block using the service rig to conduct well service operations and after conducting well service operations, moving the upper snubbing unit into a position with its axis installed over well center to operate the travelling snubbing slip assembly to drive another tubular relative to the well.

50. The method of claim 46 wherein after gripping the tubular using the stationary snubbing slip assembly, the method further comprises moving the upper snubbing unit into a stored position and lowering the mast into the storage position.

51. A method for moving wellbore tubulars into a wellhead, the method comprising: setting up a service rig adjacent the wellhead, the service rig, a mast pivotally connected to the service rig and moveable between a storage position and an erected position and a block supported on the mast; an upper snubbing unit connected by a pivotal connection to the mast, the upper snubbing unit including a first driving ram and a second driving ram, each including a mounted end and an outboard end, each of the first driving ram and the second driving ram being connected at the pivotal connection to the mast adjacent their mounted ends and a travelling snubbing slip assembly mounted between the outboard ends of the first driving ram and the second driving ram; positioning the mast in the erected position; connecting a stationary snubbing slip assembly to the well head; positioning the upper snubbing unit into a position for snubbing tubular into the wellhead; lifting a tubular into a position substantially aligned with a center well axis; gripping the tubular using the travelling snubbing slip assembly; driving the first driving ram and the second driving ram to drive the travelling snubbing slip assembly away from the mast and toward the stationary snubbing slip assembly to force the tubular through the stationary snubbing slip assembly and into the well head; gripping the tubular using the stationary snubbing slip assembly; and after gripping the tubular using the stationary snubbing slip assembly, moving the upper snubbing unit into a stored position and conducting well service operations including operating a travelling block using the service rig to conduct well service operations.

52. The method of claim 51 wherein driving the first driving ram and the second driving ram includes extending piston rods to push against the mast.

53. The method of claim 51 wherein during moving the upper snubbing unit, the stationary snubbing slip assembly remains connected to the wellhead.

54. The method of claim 51 wherein after conducting well service operations, the method further comprises moving the upper snubbing unit into a position with its axis installed over well center to operate the travelling snubbing slip assembly to drive another tubular relative to the well.

55. The method of claim 51 wherein after gripping the tubular using the stationary snubbing slip assembly, the method further comprises moving the upper snubbing unit into a stored position and lowering the mast into the storage position.

56. A method for moving wellbore tubulars into a wellhead, the method comprising: setting up a service rig adjacent the wellhead, the service rig, a mast pivotally connected to the service rig and moveable between a storage position and an erected position and a block supported on the mast; an upper snubbing unit connected by a pivotal connection to the mast, the upper snubbing unit including a first driving ram and a second driving ram, each including a mounted end and an outboard end, each of the first driving ram and the second driving ram being connected at the pivotal connection to the mast adjacent their mounted ends and a travelling snubbing slip assembly mounted between the outboard ends of the first driving ram and the second driving ram; positioning the mast in the erected position; connecting a stationary snubbing slip assembly to the well head; positioning the upper snubbing unit into a position for snubbing tubular into the wellhead; lifting a tubular into a position substantially aligned with a center well axis; gripping the tubular using the travelling snubbing slip assembly; driving the first driving ram and the second driving ram to drive the travelling snubbing slip assembly away from the mast and toward the stationary snubbing slip assembly to force the tubular through the stationary snubbing slip assembly and into the well head; gripping the tubular using the stationary snubbing slip assembly; and after gripping the tubular using the stationary snubbing slip assembly, moving the upper snubbing unit into a stored position and lowering the mast into the storage position.

57. The method of claim 56 wherein driving the first driving ram and the second driving ram includes extending piston rods to push against the mast.

58. A wellbore tubular handling system for moving tubulars into a wellhead, the system being mountable to a slightly over-vertical mast at or near the wellhead, the system comprising:

a block supportable on the mast;

an upper snubbing unit pivotally connectable to the mast at a first pivotal connection, the upper snubbing unit including a first driving ram and a second driving ram, each including a mounted end and an outboard end, each of the first driving ram and the second driving ram being pivotally connectable to the mast adjacent their mounted ends;

a travelling snubbing slip assembly mounted to the outboard ends of the first driving ram and the second driving ram and being drivable toward and away from the mounted ends by the first driving ram and the second driving ram;

a stationary snubbing slip assembly configured for connection to the wellhead; and an upper snubbing unit positioning apparatus for moving the upper snubbing unit about the first pivotal connection between a stored position and an operative position, wherein the upper snubbing unit positioning apparatus includes a hydraulic cylinder for driving the upper snubbing unit about the first pivotal connection.

59. The wellbore tubular handling system of claim 58 wherein the upper snubbing unit is further pivotally connectable to the mast at a second pivotal connection, and the system further comprising a second hydraulic cylinder for driving the upper snubbing unit about the second pivotal connection.

60. A wellbore tubular handling system for moving tubulars into a wellhead, the system being mountable to a slightly over-vertical mast at or near the wellhead, the system comprising:

a block supportable on the mast;

an upper snubbing unit pivotally connectable to the mast at a first pivotal connection, the upper snubbing unit including a first driving ram and a second driving ram, each including a mounted end and an outboard end, each of the first driving ram and the second driving ram being pivotally connectable to the mast adjacent their mounted ends;

a travelling snubbing slip assembly mounted to the outboard ends of the first driving ram and the second driving ram and being drivable toward and away from the mounted ends by the first driving ram and the second driving ram;

a stationary snubbing slip assembly configured for connection to the wellhead; and an upper snubbing unit positioning apparatus for moving the upper snubbing unit about the first pivotal connection between a stored position and an operative position, wherein, when connected to the mast and in the stored position, the upper snubbing unit is recessed on to the mast.

61. A wellbore tubular handling system for moving tubulars into a wellhead, the system being mountable to a slightly over-vertical mast at or near the wellhead, the system comprising:

a block supportable on the mast;

an upper snubbing unit pivotally connectable to the mast at a first pivotal connection, the upper snubbing unit including a first driving ram and a second driving ram, each including a mounted end and an outboard end, each of the first driving ram and the second driving ram being pivotally connectable to the mast adjacent their mounted ends;

a travelling snubbing slip assembly mounted to the outboard ends of the first driving ram and the second driving ram and being drivable toward and away from the mounted ends by the first driving ram and the second driving ram;

a stationary snubbing slip assembly configured for connection to the wellhead; and a tensioned cable connected between the upper snubbing unit and the wellhead to distribute forces of a snubbing operation from the upper snubbing unit to the wellhead.

62. A method for moving wellbore tubulars into a wellhead, the method comprising:

supporting a block on a mast at or near the wellhead, the mast being in a slightly over-vertical position;

connecting an upper snubbing unit by a pivotal connection to the mast, the upper snubbing unit including a first driving ram and a second driving ram, each including a mounted end and an outboard end;

connecting each of the first driving ram and the second driving ram at the pivotal connection adjacent their mounted ends, the outboard ends having a travelling snubbing slip assembly mounted therebetween;

connecting a stationary snubbing slip assembly to the wellhead;

positioning the upper snubbing unit into a position for snubbing tubular into the wellhead;

lifting a tubular into a position substantially aligned with a center well axis;

gripping the tubular using the travelling snubbing slip assembly;

driving the first driving ram and the second driving ram to drive the travelling snubbing slip assembly away from the mast and toward the stationary snubbing slip assembly to force the tubular through the stationary snubbing slip assembly and into the wellhead; and gripping the tubular using the stationary snubbing slip assembly; and connecting a tensioned cable between the wellhead and the upper snubbing unit to distribute forces generated during driving from the upper snubbing unit to the wellhead.

63. A method for moving wellbore tubulars into a wellhead, the method comprising:

supporting a block on a mast at or near the wellhead, the mast being in a slightly over-vertical position;

connecting an upper snubbing unit by a pivotal connection to the mast, the upper snubbing unit including a first driving ram and a second driving ram, each including a mounted end and an outboard end;

connecting each of the first driving ram and the second driving ram at the pivotal connection adjacent their mounted ends, the outboard ends having a travelling snubbing slip assembly mounted therebetween;

connecting a stationary snubbing slip assembly to the wellhead;

positioning the upper snubbing unit into a position for snubbing tubular into the wellhead;

lifting a tubular into a position substantially aligned with a center well axis;

gripping the tubular using the travelling snubbing slip assembly;

driving the first driving ram and the second driving ram to drive the travelling snubbing slip assembly away from the mast and toward the stationary snubbing slip assembly to force the tubular through the stationary snubbing slip assembly and into the wellhead;

gripping the tubular using the stationary snubbing slip assembly; and after gripping the tubular using the stationary snubbing slip assembly, moving the upper snubbing unit into a stored position and conducting well service operations including operating a travelling block using a service rig to conduct well service operations.

64. The method of claim 63 wherein during moving the upper snubbing unit, the stationary snubbing slip assembly remains connected to the wellhead.

65. The method of claim 63 wherein after conducting well service operations, the method further comprises moving the upper snubbing unit into a position with its axis installed over well center to operate the travelling snubbing slip assembly to drive another tubular relative to the wellhead.

66. A method for moving wellbore tubulars into a wellhead, the method comprising:

supporting a block on a mast at or near the wellhead, the mast being in a slightly over-vertical position;

connecting an upper snubbing unit by a pivotal connection to the mast, the upper snubbing unit including a first driving ram and a second driving ram, each including a mounted end and an outboard end;

connecting each of the first driving ram and the second driving ram at the pivotal connection adjacent their mounted ends, the outboard ends having a travelling snubbing slip assembly mounted therebetween;

connecting a stationary snubbing slip assembly to the wellhead;

positioning the upper snubbing unit into a position for snubbing tubular into the wellhead;

lifting a tubular into a position substantially aligned with a center well axis;

gripping the tubular using the travelling snubbing slip assembly;

driving the first driving ram and the second driving ram to drive the travelling snubbing slip assembly away from the mast and toward the stationary snubbing slip assembly to force the tubular through the stationary snubbing slip assembly and into the wellhead;

gripping the tubular using the stationary snubbing slip assembly; and after gripping the tubular using the stationary snubbing slip assembly, moving the upper snubbing unit into a stored position and lowering the mast into a storage position.

* * * * *